US005329961A

United States Patent [19]

Bouvyn et al.

[11] Patent Number: 5,329,961

[45] Date of Patent: Jul. 19, 1994

[54] REED WITH OPTICAL WEFT DETECTOR

[75] Inventors: Patrick Bouvyn, Waregem; Frans Vandenabeele, Zonnebeke-Beselare, both of Belgium

[73] Assignee: Barco N.V. and Picanol N.V., Belgium

[21] Appl. No.: 81,140

[22] Filed: Jun. 25, 1993

[30] Foreign Application Priority Data

Jul. 3, 1992 [BE] Belgium ..... 09200620

[51] Int. Cl.[5] ..... D03D 51/34

[52] U.S. Cl. ..... 139/370.2; 250/561; 250/571

[58] Field of Search ..... 250/561, 571; 139/370.2, 1 C, 370.1, 192

[56] References Cited

U.S. PATENT DOCUMENTS 4,295,499 10/1981 Suzuki et al. ..... 139/370.2
4,565,224 1/1986 Keller ..... 139/370.2
4,716,942 1/1988 Jensen et al. .
4,738,284 4/1988 Ishikawa et al. .
4,805,671 2/1989 Castellini et al. ..... 139/370.2

FOREIGN PATENT DOCUMENTS 137380 4/1985 European Pat. Off. .
290706 11/1988 European Pat. Off. .

*Primary Examiner*—Andrew M. Falik
*Attorney, Agent, or Firm*—Bacon & Thomas

[57] ABSTRACT

A loom having an optical weft detector which includes a light emitter and a light detector for picking up light reflected by a weft thread in a guide duct formed by blades of the reed, is mounted on the side of the reed which faces away from the guide duct and outside the blades, the detection zone of the light detector being spatially limited to the light reflected by the weft thread in the guide duct.

10 Claims, 2 Drawing Sheets

REED WITH OPTICAL WEFT DETECTOR

BACKGROUND OF THE INVENTION

1. Field of the Invention

The invention concerns a loom having a reed which includes a plurality of blades forming a guide duct for a weft thread, and an optical weft detector containing a light emitter and a light detector for picking up light reflected from the weft thread.

2. Description of the Related Art

A loom having a reed which includes a plurality of blades forming a guide duct for a weft thread, and also an optical weft detector, is disclosed in U.S. Pat. No. 4,738,284. The light emitter and light detector of the weft detector are mounted in the vicinity of the open side of the substantially U-shaped guide duct. They are affixed to the batten and have a needle-like shape similar to that of accessory blow nozzles, so that they are able to enter the shed jointly with the batten. In this design, the light from the emitter is reflected not only by a weft thread passing through the duct but by the blades forming the guide duct. As a result, it is difficult to detect the incoming weft thread because the amount of light picked up by the light detector also depends on the soiling of the guide duct, and it is especially difficult to detect a weft thread which does not reflect a large amount of light.

Optical weft detectors are also used in the looms disclosed in U.S. Pat. No. 4,716,942, and European patent documents A 137,380 and A 290,706. In these looms, a light emitter and a light detector are mounted on the side of the reed which faces away from the guide duct, outside the blades and offset in height. Light deflecting components such as mirrors or prisms are mounted between the blades to deflect the light beam from the light emitter to the light detector, and the presence of a weft thread is determined when the light beams are interrupted. Such a weft detector suffers from the drawback that thin weft threads can be detected only with great difficulty. Furthermore, this design is disadvantageous in that the light deflecting means are mounted between the blades of the reed and therefore may damage the reed, and also in that it is cumbersome to weave narrow or wide cloths on the same loom because the light deflecting means must be reassembled each time the width is changed. Furthermore, there is a danger that, in the case of air jet looms, these light guides will interfere with the air flow in the guide duct and may lead to weaving defects.

SUMMARY OF THE INVENTION

Accordingly, it is a principal objective of the invention to create a weft detector for a loom of the type in which the reed includes a plurality of blades forming a guide duct for the weft thread and which includes an optical weft detector, wherein the weft detector responds essentially only to light reflected from incoming weft threads and yet which is operative without accessories mounted between the blades of the reed.

This objective is achieved in a preferred embodiment of the invention by mounting the light emitter and light detector of the optical weft detector on the side of the reed which faces away from the guide duct and outside the blades, and by spatially limiting the detection range of the light detector to detect only light beams reflected from a weft thread in the guide duct.

In this embodiment, when the light beams from the light emitter are reflected, they pass by the reed blades twice on their path to the light detector, so that the blades serve as a kind of filter or screen which eliminates interferences caused by reflections to the light detector from the edges of the blades or from lateral components such as fabrics or warps. As a result, only those light beams from the light emitter which are reflected by a weft thread present in the guide duct are detected by the light detector. No elements of the weft detector are present between the blades of the reed, thus preventing damage to the blades. Moreover, the preferred weft detector is easily displaced along the reed, making it possible to more easily weave fabrics of different widths. Finally, when applied to air jet looms, the preferred arrangement has the advantage that the air flow in the guide duct remains unaffected by the weft detector.

DETAILED DESCRIPTION OF THE PREFERRED EMBODIMENT

Figure 2:
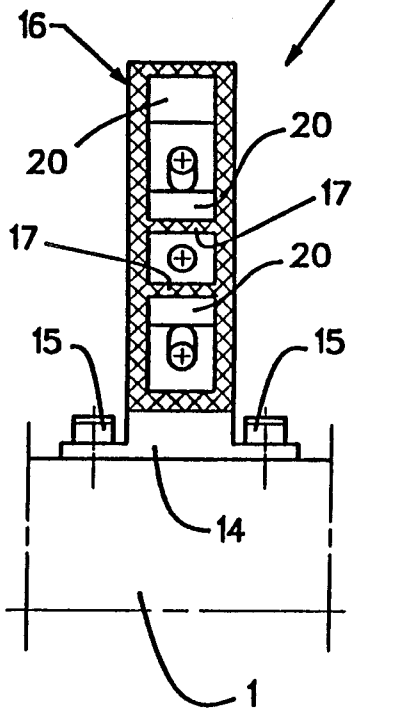
FIG. 2 is an elevated view in the direction of the arrow F2 of FIG. 1 toward the weft detector.
Figure 1:
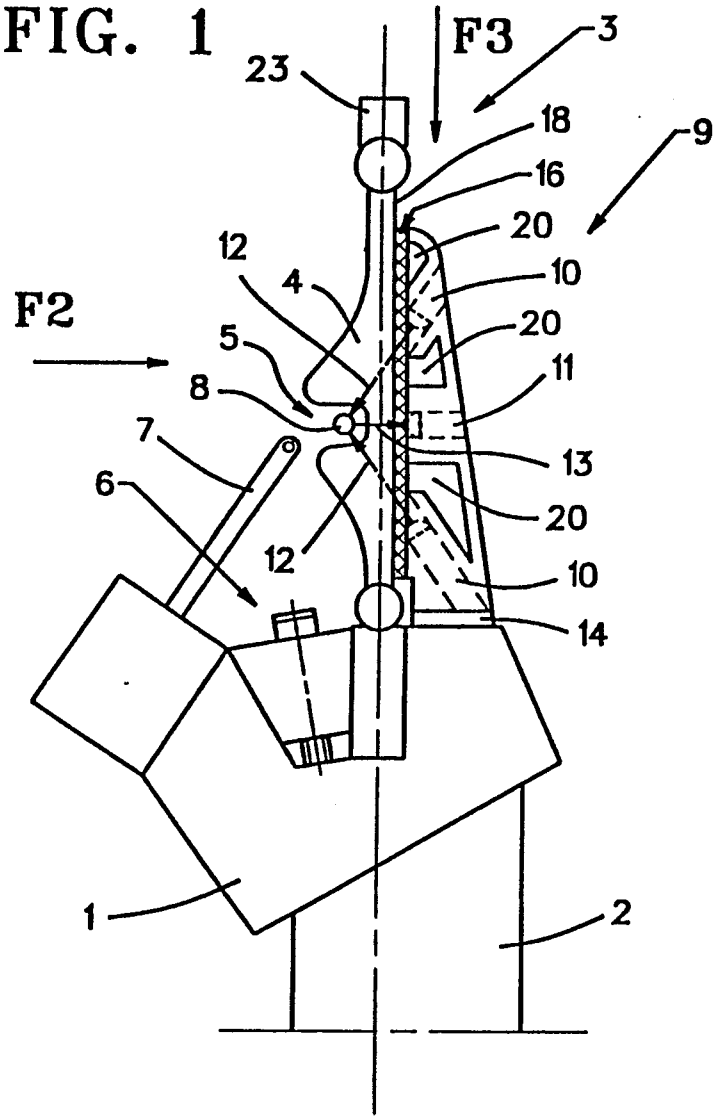
FIG. 1 is a cutaway view of an air jet loom equipped with a weft detector constructed in accordance with the principles of a preferred embodiment of the invention.

FIGS. 1–4 show an air jet loom section including a batten extrusion 1 mounted on legs 2 affixed to a batten shaft (not shown). A reed 3 is affixed by a fastener 6 to the batten extrusion 1. The reed 3 is made up of a plurality of blades 4 which together form a guide duct 5 for an incoming weft thread 8. For that purpose, in this embodiment, the blades 4 each include a U-shaped recess. The weft 8 is inserted by a main jet nozzle (not shown) and is further moved by accessory jet nozzles 7 in known manner into the guide duct 5, the nozzles 7 being mounted to face the open side of the guide duct 5.

A weft detector 9 is mounted to the batten extrusion 1 on the side of the reed which faces away from the guide duct 5, and is held in place by, for example, screws 15. Because no elements of the weft detector 9 enter the gaps between the blades 4, the weft detector can be displaced arbitrarily and in simple manner on the batten extrusion 1 following loosening of the screws 15 to match a changed fabric width, and can easily be fastened again by tightening the screws. Also, because weft detector 9 is mounted as a whole on the side away from the guide duct 5, it will not affect the air flow in the guide duct 5.

The weft detector 9 contains two light emitters 10 mounted in superposition in a plane parallel to the surfaces of the blades 4, one of the emitters 10 pointing obliquely from the top and the other obliquely from the bottom into the guide duct 5. A light detector 11 is mounted between the two light emitters 10 and in the same plane. Light detector 11 points substantially perpendicularly to the back wall of the guide duct 5 and hence substantially parallel to the top and lower sides thereof. As shall be elucidated below in relation to FIGS. 3 and 4, the light beams 12 from the light emitters are pointed in such a way that no surfaces or the like are encountered by the beams 12 on their way to a weft thread 8 inside the guide duct 5 that would reflect a light beam to the light detector 11. The light beams 13 reflected to the light detector 11 therefore unequivocally come from the weft thread 8.

The light emitters 10 and the light detector 11 are mounted in a common holder 14 while being offset in height. An elastic, for example rubber, insert 16 is present between the holder 14 and the blades 4 of the reed 3. Insert 16 serves to connect the holder 14 to the blades 4 without damaging the latter, prevents vibrations in the holder 14 of the weft detector 9 from being transmitted to the blades, and suppresses oscillations of the blades 4. Insert 16 has an annular contour and is divided by two cross-strips 17 in such a way that three mutually separate frames, contiguous with the sides of blades 4 which face away from the guide ducts 5, are thereby created which enclose the light emitters 10 and the light detector 11, as shown in FIG. 3.

To prevent soiling or dust accumulation inside the weft detector 9, the holder 14 is fitted with apertures 20 for permitting passage of air and dust or the like. Moreover the walls 21 enclosing the light emitters 10 and the light detector 11 are frusto-conical. As a result, the weft detector 9 is able to self-clean on account of the air flow generated by the batten motion to beat the reed 3. In another embodiment, an additional blow nozzle may be provided for cleaning. Though not shown in the drawing, an aperture may also be provided in the zone of the light detector to allow passage of the flow of cleaning air.

Figure 4:
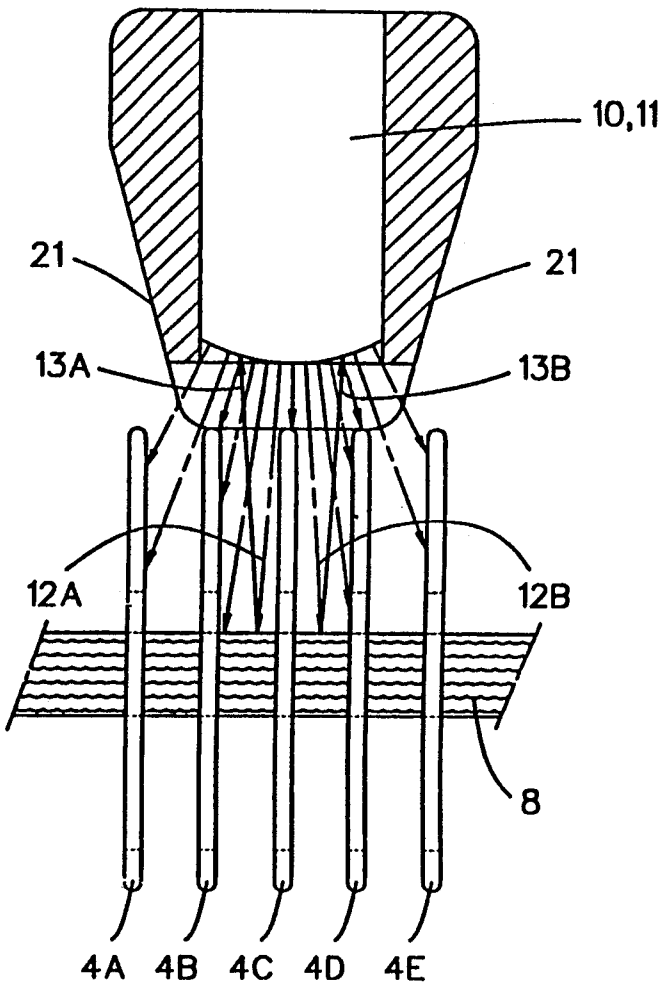
FIG. 4 is a partly sectional view in the direction of arrow F3 of FIG. 1.
Figure 3:
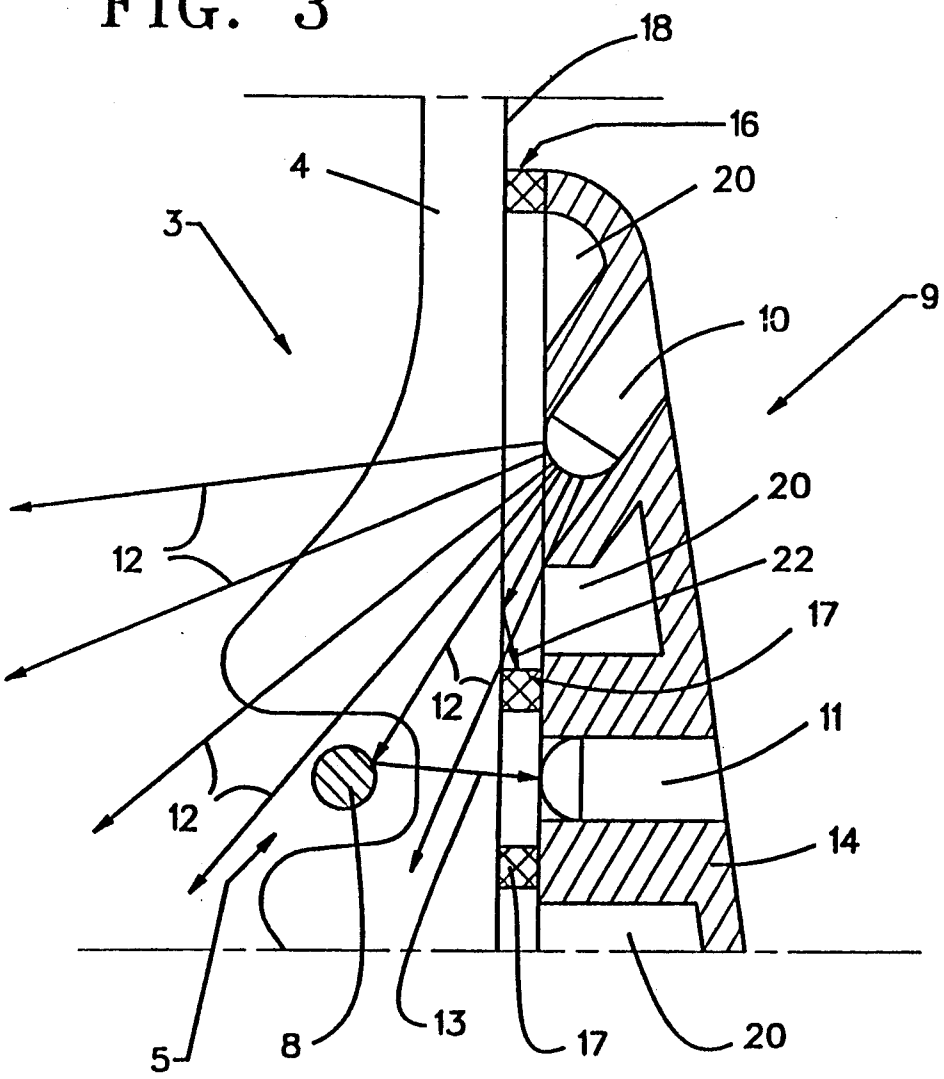
FIG. 3 is identical to FIG. 1 but on an enlarged scale.

As shown by FIGS. 3 and 4, the light emitters 10 emit a diverging light beam with a specific angle of divergence, as a result of which the entire guide duct 5 is illuminated. FIG. 3 shows a limited number of light rays 12 and one reflected light ray 13. The light emitters 10 are controlled by a control unit (not shown) in such a manner that they emit light rays 12 of a wavelength absent from the ambient light. The light detector is controlled by a second control unit (not shown) in such a way that light other than reflected emitter light is eliminated. Consequently, the ambient light cannot affect the signal to be analyzed.

As shown by FIG. 3, the light emitters 10 and the light detector 11 subtend an angle, for example 45°, relative to the back side 18 of the blades 4 of the reed 3 such that essentially no light reflected from the back of the blades can be picked up by the light detector 11. The cross strips 17 of the elastic insert 16 are located between the light emitters 10 and the light detector 11 to fully exclude such light, as is illustratively indicated by arrow 22 in FIG. 3.

The functional diagram of FIG. 4 shows that the blades 4 of the reed 3 operate in the manner of a spatial filter or baffle. A light emitter 10 radiates a diverging beam with a defined angle of divergence. Because the light emitter is mounted near the back sides 18 of the blades 4, light can penetrate only through the gaps between a limited number of blades 4A through 4E. Part of the light illustrated by the rays 12A and 12B is reflected by a weft thread 8. The reflected rays 13A and 13B are picked up by the light detector 11. In addition, part of the light rays to the side of the above-mentioned rays are reflected first by the walls of the blades 4 and then by the weft thread 8, and again may reach the light detector 11. However, the intensity of these latter rays will be less than at emission because they have been partly absorbed by the walls of the blades 4. Light not reflected by the weft thread cannot reach the light detector. Light reflected from elements to the side of the blades 4A through 4E cannot reach the light detector 11 because such light cannot pass between the blades 4A through 4E. The blades 4A–4E thus form a spatial filter for the reflected rays.

Because the light beam from the light emitter 10 has a defined and comparatively large angle of divergence, those reflections from elements located far from the light emitter cannot reach the light detector 11. They do not arrive between the blades 4A through 4E because the blades form a spatial filter. The larger the angle of divergence of the light beam, the smaller the distance within which the weft detector 9 may sense an element on account of reflected light. Accordingly, the angle of divergence is selected in such manner that the weft detector 9 can only sense those elements which are located within the guide duct 5. This spatial filtering thus allows elimination of, in particular, lateral spurious signals, so that essentially only the light reflected by a weft thread 8 present in the guide duct 5 can reach the light detector 11. When no weft thread 8 is present in the guide duct 5, practically no light can reach the light detector 11 and accordingly the signal-value at this light detector is very low. If, nevertheless, the signal value were to be high, it would follow that the weft detector 9 had failed, whereupon the loom would be shut down.

The detection zone in the filling-stop-motion 9 extends across a number of blades 4 of the reed 3. This feature offers the advantage that accurate positioning of the weft detector 9 relative to the blades 4 is not required.

It will be apparent to those skilled in the art based on the above that the weft detector 9 may be designed with only one light emitter 10 and one light detector 11, or with two light detectors 11 and one light emitter 10. The use of two light emitters 10 and one light detector 11 allows amplification of the picked-up signals to increase the sensitivity of the weft detector. When using two light emitters, the magnitude of the signal picked up by the light detector 11 is less affected by the position of the weft thread 8 in the guide duct 5, as a result of which the sensitivity of the weft detector 9 is significantly invariant across the guide duct 5.

Reflection in the presence of various kinds or colors of weft thread 8 is dependent on the wavelength of the emitted light beams, and it is possible when using two light emitters 10 to have each emitter radiate a different wavelength to assure good reflection for a particular kind or color of a weft thread 8. Consequently, the sensitivity of the weft detector 9 is substantially invariant with respect to different colors or kinds of weft threads.

In a variation of the preferred embodiment, the weft detector 9 is affixed not to the batten extrusion 1, but illustratively instead by a clamp or clip or the like to the upper reed extrusion 23. These and other variations of the preferred embodiment which may occur to those skilled in the art are intended to be included within the scope of the invention, and thus the invention is not to be limited by the above-description or by the drawings, but rather should be limited only by the appended claims.

We claim:

1. In a loom having a reed which includes a plurality of blades forming a guide duct for a weft thread, and an optical weft detector comprising means including a light emitter for emitting light and means including a light detector for picking up portions of said light which are reflected by the weft thread, the improvement wherein:

the light emitter and the light detector are mounted outside the blades on a side of the reed which faces away from the guide duct, and further comprising means including said blades for spatially limiting a detection zone of the light detector to a zone defined by light rays reflected in the guide duct by the weft thread.

2. A loom as claimed in claim 1, further comprising a frame contiguous with a side of the blades which faces away from the guide duct, said frame including crossbars positioned between the light emitter and the light detector to form means for excluding light reflected from said side of said blades from reaching said detector, said means for excluding light reflected from the blades thereby constituting part of said means for spatially limiting the detection zone of the light detector to light reflected from the weft.

3. A loom as claimed in claim 1, wherein the light detector is enclosed by a frame contiguous with a side of the blades which faces away from the guide duct.

4. A loom as claimed in claim 1, wherein the light emitter is enclosed by a frame contiguous with a side of the blades which faces away from the guide duct, said frame having a width in a longitudinal direction of the reed which corresponds to a width of a frame enclosing the light detector.

5. A loom as claimed in claim 1, wherein the light emitter includes means for generating a beam of diverging light rays.

6. A loom as claimed in claim 1, wherein the light detector is mounted opposite an open side of the guide duct.

7. A loom as claimed in one of claim 1, wherein the light emitter subtends an angle of 45° relative to a side of the blades which faces away from the guide duct, the light emitter pointing at the guide duct.

8. A loom as claimed in claim 1, further comprising a second light emitter, the first and second light emitters pointing from different directions at the guide duct.

9. A loom as claimed in claim 8, wherein the first and second light emitters include means for generating light beams of different wavelengths.

10. A loom as claimed in claim 1, wherein the light emitter and the light detector are mounted in a common holder.

* * * * *